US007565089B2

(12) United States Patent
Jang et al.

(10) Patent No.: US 7,565,089 B2
(45) Date of Patent: Jul. 21, 2009

(54) FUSING ROLLER AND FUSING DEVICE USING THE SAME

(75) Inventors: Jae-hyeok Jang, Seoul (KR); Hwan-guem Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 400 days.

(21) Appl. No.: 11/417,042

(22) Filed: May 4, 2006

(65) Prior Publication Data

US 2006/0291892 A1 Dec. 28, 2006

(30) Foreign Application Priority Data

Jun. 25, 2005 (KR) ..... 10-2005-0055423

(51) Int. Cl.
*G03G 15/00* (2006.01)
*G03G 15/20* (2006.01)

(52) U.S. Cl. ..... 399/90; 399/330

(58) Field of Classification Search ..... 399/90, 399/330; 219/619, 216
See application file for complete search history.

(56) References Cited

U.S. PATENT DOCUMENTS

| | | | | |
|---|---|---|---|---|
| 4,180,717 | A * | 12/1979 | Lenk et al. | 219/619 |
| 4,724,305 | A * | 2/1988 | Iimura et al. | 219/216 |
| 5,932,125 | A * | 8/1999 | Kawata et al. | 219/216 |
| 7,340,207 | B2 * | 3/2008 | Cho et al. | 399/90 |
| 2003/0044204 | A1 | 3/2003 | Lee | |
| 2003/0091362 | A1 * | 5/2003 | Kinouchi et al. | 399/90 |
| 2003/0091374 | A1 * | 5/2003 | Lee et al. | 399/330 |
| 2004/0047660 | A1 * | 3/2004 | Kim et al. | 399/330 |
| 2004/0120741 | A1 * | 6/2004 | Kim et al. | 399/330 |
| 2004/0253028 | A1 * | 12/2004 | Kim et al. | 399/330 |
| 2006/0093415 | A1 * | 5/2006 | Cho et al. | |

FOREIGN PATENT DOCUMENTS

| | | |
|---|---|---|
| CN | 1142624 | 2/1997 |
| JP | 11-015317 | 1/1999 |
| JP | 11-339940 | 12/1999 |
| JP | 2001-148278 | 5/2001 |
| JP | 2001-160476 | 6/2001 |

(Continued)

OTHER PUBLICATIONS

Korean Office Action dated Aug. 28, 2006 issued in KR 2005-55423.
Chinese Office Action dated Jun. 6, 2008 issued in CN 2006100908587.

*Primary Examiner*—Susan S Lee
(74) *Attorney, Agent, or Firm*—Stanzione & Kim LLP

(57) ABSTRACT

A fusing roller and a fusing device using the fusing roller. The fusing roller applies heat to a toner image and fuses the toner image onto a piece of paper and is heated by a coil connected to an external power source. The fusing roller includes a pair of end caps which are provided at opposite ends of the fusing roller, a connection electrode which is disposed in one of the end caps and connected to the external power source, and an adherence member which is coupled with the connection electrode, and having an end portion of the coil disposed between the adherence member and the connection electrode to ensure an electric connection between the coil and the connection electrode.

29 Claims, 4 Drawing Sheets

FOREIGN PATENT DOCUMENTS

| | | |
|---|---|---|
| JP | 2002-043038 | 2/2002 |
| JP | 2003-091191 | 3/2003 |
| JP | 2003-241556 | 8/2003 |
| JP | 2003-302851 | 10/2003 |
| JP | 2004-109649 | 4/2004 |
| JP | 2004-220037 | 8/2004 |

* cited by examiner

FUSING ROLLER AND FUSING DEVICE USING THE SAME

CROSS-REFERENCE TO RELATED APPLICATIONS

This application claims the benefit under 35 U.S.C. §119 of Korean Patent Application No. 10-2005-55423, filed on Jun. 25, 2005, in the Korean Intellectual Property Office, the disclosure of which is incorporated herein in its entirety.

BACKGROUND OF THE INVENTION

1. Field of the Invention

The present general inventive concept relates to a fusing roller and a fusing device of an electrophotographic image forming apparatus, and more particularly, to a fusing roller which is heated by a wound coil that is connected at an end portion to an external power source, and a fusing device using the fusing roller.

2. Description of the Related Art

Conventional image forming apparatuses, such as laser beam printers, LED printers, digital copy machines, and facsimiles, transfer an image onto a piece of paper according to a digital signal input from a computer or a scanner.

Electrophotographic image forming apparatuses form an electrostatic latent image corresponding to a desired image on the outer circumferential surface of a photoconductor by irradiating light on a predetermined pattern according to a digital signal corresponding to the desired image to be printed, develop the electrostatic latent image using a powder type toner, transfer the electrostatic latent image onto a piece of paper directly or via a transfer medium, and perform a fusing process on the electrostatic latent image.

Thus, the electrophotographic image forming apparatus includes a fusing device which fuses a toner image transferred onto the piece of paper by applying heat and pressure thereto. The fusing device includes a pair of rollers which face each other and rotate. The pair of rollers includes a heat roller which heats the piece of paper using a heat source, such as a halogen lamp or a resistance heating coil, and a pressure roller which faces the heat roller and contacts the heat roller.

If the heat roller is heated using a coil connected to an external power source, a predetermined connection structure, in which an end portion of the coil is connected to the external power source when the heat roller rotates, is provided at an end portion of the heat roller. Such a connection structure normally includes an end cap which rotatably supports the heat roller with respect to a main frame of the image forming apparatus and a connection electrode which is placed in the end cap and connected to the external power source. However, if physical contact between the end portion of the coil and the connection electrode is not ensured by a sufficient bonding force, a short or an arc may occur between the end portion of the coil and the connection electrode.

SUMMARY OF THE INVENTION

The present general inventive concept provides a fusing roller in which physical contact between an end portion of a coil and a connection electrode is maintained by a sufficient bonding force such that an electric connection can be stably maintained, and a fusing device using the fusing roller.

The present general inventive concept also provides a fusing roller in which both resistance heating and inducing heating are generated by applying an alternating current to a coil and stably maintaining an electric connection between the coil and a connection electrode, and a fusing device using the roller.

Additional aspects and utilities of the present general inventive concept will be set forth in part in the description which follows and, in part, will be obvious from the description, or may be learned by practice of the general inventive concept.

The foregoing and/or other aspects of the present general inventive concept are achieved by providing a fusing roller which applies heat to a toner image and fuses the toner image onto a piece of paper and which is heated by a coil connected to an external power source, the fusing roller including a pair of end caps provided at opposite ends of the fusing roller, a connection electrode disposed in one of the end caps and connected to the external power source, and an adherence member coupled with the connection electrode, and having an end portion of the coil disposed between the adherence member and the connection electrode to ensure an electric connection between the coil and the connection electrode.

The foregoing and/or other aspects of the present general inventive concept are also achieved by providing a fusing roller which applies heat to a toner image and fuses the toner image onto a piece of paper, the fusing roller including a coil which generates an alternating magnetic flux by an alternating current applied by an external power source through a connection structure, and an inducing heating portion disposed near the coil and heated by an inducing current induced by the alternating magnetic flux generated by the coil, wherein the connection structure includes a pair of end caps provided at opposite ends of the fusing roller, a connection electrode disposed in one of the end caps and connected to the external power source, and an adherence member coupled with the connection electrode, and having an end portion of the coil disposed between the adherence member and the connection electrode, to ensure an electric connection between the coil and the connection electrode.

The foregoing and/or other aspects of the present general inventive concept are also achieved by providing a fusing device which applies heat to a toner image and fuses the toner image onto a piece of paper and which includes a fusing roller heated by a coil connected to an external power source and a pressure roller that faces the fusing roller and rotates to press the piece of paper onto the fusing roller, wherein the fusing roller includes a pair of end caps provided at opposite ends of the fusing roller, a connection electrode disposed in one of the end caps and connected to the external power source, and an adherence member coupled with the connection electrode, and having an end portion of the coil disposed between the adherence member and the connection electrode to ensure an electric connection between the coil and the connection electrode.

The foregoing and/or other aspects of the present general inventive concept are also achieved by providing a fusing device which applies heat to a toner image and fuses the toner image onto a piece of paper and which includes a fusing roller heated by a coil connected to an external power source and a pressure roller that faces the fusing roller and rotates to press the piece of paper onto the fusing roller, wherein the fusing roller includes a coil which generates an alternating magnetic flux by an alternating current applied by an external power source through a connection structure, and an inducing heating portion which is placed near the coil and is heated by an inducing current induced by the alternating magnetic flux generated by the coil, wherein the connection structure includes a pair of end caps provided at opposite ends of the fusing roller, a connection electrode disposed in one of the end caps and connected to the external power source, and an adherence member coupled with the connection electrode, and having an end portion of the coil disposed between the adherence member and the connection electrode to ensure an electric connection between the coil and the connection electrode.

The foregoing and/or other aspects of the present general inventive concept are also achieved by providing a fusing roller usable in an electrophotographic image forming apparatus to fuse an image onto a printing medium, including a connection electrode electrically connected to an external power source, a coil to generate heat and having a connecting portion to contact a surface of the connection electrode to supply power to the coil, and an adherence member to press the connecting portion against the surface of the connection electrode and coupled with the connecting electrode to hold the connecting portion against the connection electrode.

The foregoing and/or other aspects of the present general inventive concept are also achieved by providing a connecting unit to connect a coil of a fusing roller with an external power source, including an end cap disposed at an end of the fusing roller, a connecting electrode disposed in the end cap, electrically connected to the external power source, and contacting an end portion of the coil to supply power to the coil, and an adherence member to hold the end portion of the coil against the connecting electrode and coupled with the connecting electrode to maintain the contact between end portion of the coil and the connecting electrode.

The foregoing and/or other aspects of the present general inventive concept are also achieved by providing an electrophotographic image forming apparatus including a fusing roller which applies heat to a toner image and fuses the toner image onto a piece of paper and which is heated by a coil connected to an external power source, the fusing roller including a pair of end caps provided at opposite ends of the fusing roller, a connection electrode disposed in one of the end caps and connected to the external power source, and an adherence member coupled with the connection electrode, and having an end portion of the coil disposed between the adherence member and the connection electrode to ensure an electric connection between the coil and the connection electrode.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
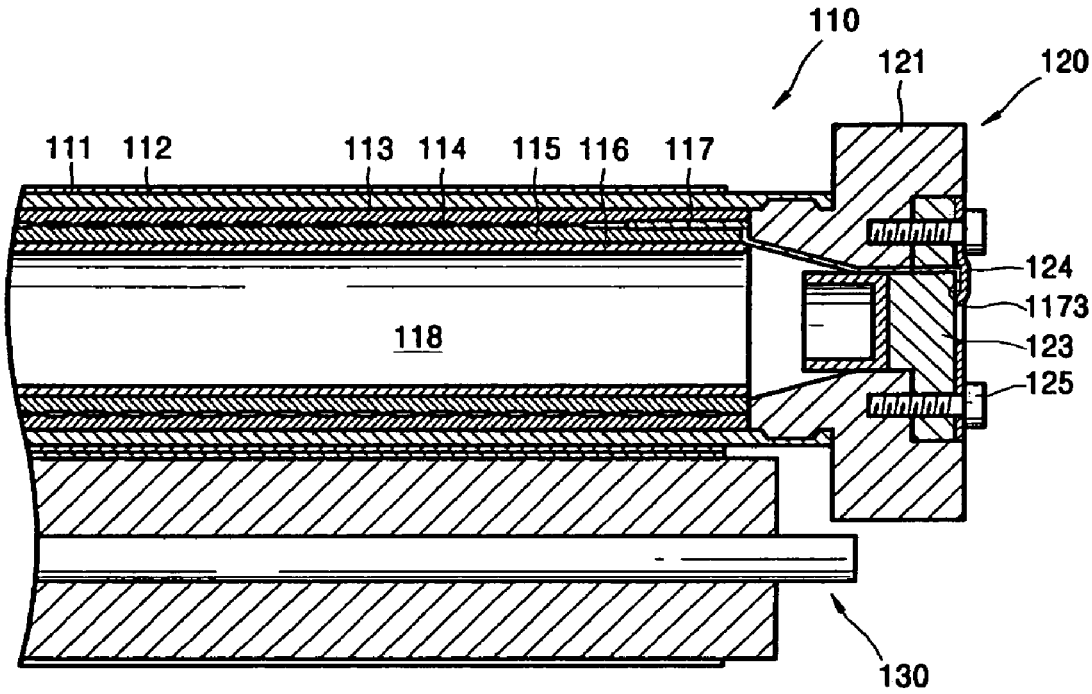
FIG. 1 is a sectional view illustrating a fusing device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a sectional view illustrating a fusing device according to an embodiment of the present general inventive concept. Referring to FIG. 1, the fusing device includes a fusing roller 110 which has a connection structure 120 provided at an end portion thereof. The connection structure 120 includes an end cap 121 placed at the end portion of the fusing roller 110 and a metal connection electrode 123 placed in a container formed at an outer portion of the end cap 121, such that a central axis of the end cap 121 and the connection electrode 123 align with each other. In the fusing roller 110, a lead member 117 is connected to an end of a coil 114. The lead member 117 extends through the end cap 121 and along one side of the connection electrode 123, and is curved at an outer end of the connection electrode 123 to widen to a contact portion 1173. The contact portion 1173 of the lead member is pressed to contact the connection electrode 123 by an adherence member 124 coupled with the connection electrode 123 by a bolt 125, or the like.

The end cap 121 can be one of a pair provided opposite ends of the fusing roller 110, and rotatably supports the fusing roller 110 with respect to a main frame of an image forming apparatus. The end cap can be made mainly of a resin. A driving force portion (not shown), such as a gear or pulley, to rotate the fusing roller 110 may be provided at the end cap 121. In addition, a container to accommodate the connection electrode 123 therein is provided to the end cap 121.

The connection electrode 123 is disposed in the container of the end cap 121 and electrically connects a power electrode of the main frame of the image forming apparatus with the coil 114, even when the fusing roller 110 rotates. The connection electrode 123 can be made of a metal material, such as a material in which a contact resistance with respect to the power electrode of the main frame is small, and electric conductivity and wear resistance are excellent.

The adherence member 124 and the connection electrode 123 may be coupled by various means, such as screw bonding, in order to ensure a strong bonding force and to facilitate assembly. As illustrated in FIG. 1, a female screw hole is formed in the connection electrode 123, and the bolt 125 is screwed in the female screw hole through the adherence member 124 to couple the adherence member 124 to the connection electrode 123. Since the connection electrode 123 is made of a metal material, such as a sintered material of Cu—Sn, even though the bolt 125 is strongly tightened, the female screw hole is not readily damaged, such that the sufficient bonding force can be ensured. Female screw holes corresponding to the female screw holes in the connection electrode 123 may be made in the end cap 121 to enhance the bonding force of the bolt 125. For example, the connection electrode 123 and the end cap 121 may each have three female screw holes, but the number thereof is not limited thereto.

The adherence member 124 may be made of a metal plate having good rigidity such that a sufficient pressure can be transferred to the contact portion 1173 of the lead member 117. In view of manufacturing characteristics and non-corrosive properties, a plate made of stainless steel (SUS), aluminum alloy, or other alloyed steel can be used as the adherence member 124. In order to prevent thermal deformation of the adherence member 124 due to heat radiated by the coil 114, the thermal resistance of the adherence member 124 should sustain approximately 200° C. When the aforementioned metal plate is used, a sufficient thermal resistance is ensured. The adherence member 124 may be coupled to the outer end of the connection electrode 123 to facilitate assembly.

As described above, since physical contact between the lead member 117 and the connection electrode 123 is ensured by the adherence member 124, an electric connection between the lead member 117 and the connection electrode 123 can be stably maintained, thereby preventing a possible short circuit or electric arc caused by contact failure.

The above described connection structure of the fusing roller 110 can be used in a resistance heating method, an inducement heating method, and a method of combing the resistance and inducement heating methods according to various embodiments of the present general inventive concept.

As illustrated in the embodiment of FIG. 1, the fusing device can use a heating method combining the resistance heating and the inducement heating.

The fusing device of the present embodiment includes the fusing roller 110 and a pressure roller 130 which faces the fusing roller 110 and rotates with the fusing roller 110. The pressure roller 130 is elastically biased towards the fusing roller 110.

The fusing roller 110 includes an induction heating portion 112, the coil 114, and an adherence portion 116. The induction heating portion 112 is made of a hollow tubular magnetic material. The surface of the induction heating portion 112 is coated with tetrafluoruethylene to form a coating layer 11 which serves to improve a mold releasing property with respect to a toner image. The induction heating portion 112 is magnetized by a magnetic field, has a conductive property that allows a predetermined current to flow therethrough, and can be made of iron (Fe) ally, copper (Cu) ally, aluminum (Al) ally, nickel (Ni) ally, and chrome (Cr) ally.

The coil 114 is disposed to spirally adhere to an inner surface of the induction heating portion 112 and generates an alternating magnetic flux that changes in response to an alternating current input from an external power source (not shown). The coil 114 can be a ribbon coil made of a copper (Cu) material.

A first insulation layer 113 is provided between the coil 114 and the induction heating portion 112, and a second insulation layer 115 is provided between the coil 114 and the adherence portion 116. Thus, damage due to the alternating current input to the coil 114 can be prevented, and the coil 114 is insulated so that a leakage current does not flow into the induction heating portion 112 or the adherence portion 116.

The first insulation layer 113 and the second insulation layer 115 have predetermined withstand voltage characteristics and non-insulation destruction characteristics. The withstand voltage characteristics refer to voltages that the first insulation layer 113 and the second insulation layer 115 can sustain when a predetermined external power is applied thereto, and the non-insulation destruction characteristics refer to a case in which insulation of the first insulation layer 113 and the second insulation layer 115 are not damaged when a leakage current less than 10 mA flows for 1 minute under a maximum withstand voltage therethrough. The first insulation layer 113 and the second insulation layer 115 may be made of mica, polyimide, ceramic, silicon, polyurethane, glass, or polytetrafluoruethylene (PTFE).

The tubular adherence portion 116 is disposed at an interior portion 118 of the induction heating portion 112, and is enlarged so that the coil 114 adheres to the induction heating portion 112. As the adherence portion 116 is enlarged, a plasticity of the adherence portion 116 is deformed, and the coil 114, the first insulation layer 113, the second insulation layer 115, and the induction heating portion 112 are thereby adhered to each other. That is, the adherence portion 116 maximizes a bonding coefficient to adhere the coil 114 to the induction heating portion 112 such that an inducing current is generated thereto without a loss in the alternating magnetic flux generated by the coil 114.

The adherence portion 116 can be made of a non-magnetic material, such as a polymer or a rubber. Accordingly, the inducing current may not be unnecessarily generated in the adherence portion 116 but generated only in the induction heating portion 112 by the alternating magnetic flux generated from the coil 114, thereby improving efficiency of the inducing heating.

Figure 2:
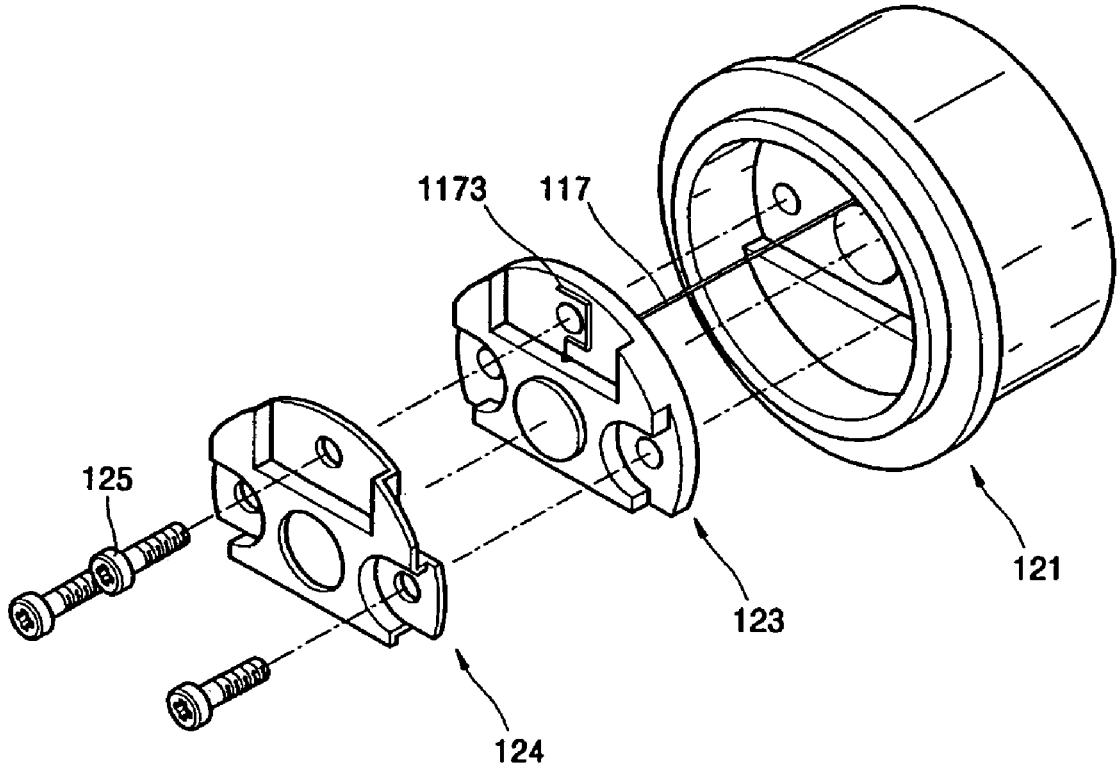
FIG. 2 is an exploded view illustrating a connection structure at an end portion of a fusing roller of the fusing device of FIG. 1.

FIG. 2 is an exploded view illustrating the connection structure 120 at an end portion of the fusing roller 110. Hereinafter, like numeral references as shown in FIG. 1 denote like elements or parts. Therefore, the same explanation may be omitted to avoid unnecessary repetition.

The lead member 117 extends from the end of the coil 114 and passes through a through-hole formed in the end cap 121 and the connection electrode 123. The connection electrode 123 is then placed in a container of the end cap 121, and the contact portion 1173 of the lead member 117 is folded to contact a surface of the connection electrode 123. The adherence member 124 is coupled to the connection electrode 123 by the bolts 125, and the contact portion 1173 of the lead member 117 disposed therebetween is pressed to adhere to the surface of the connection electrode 123. The bolts 125 are sufficiently screwed to ensure physical contact between the lead member 117 and the connection electrode 123.

Figure 3:
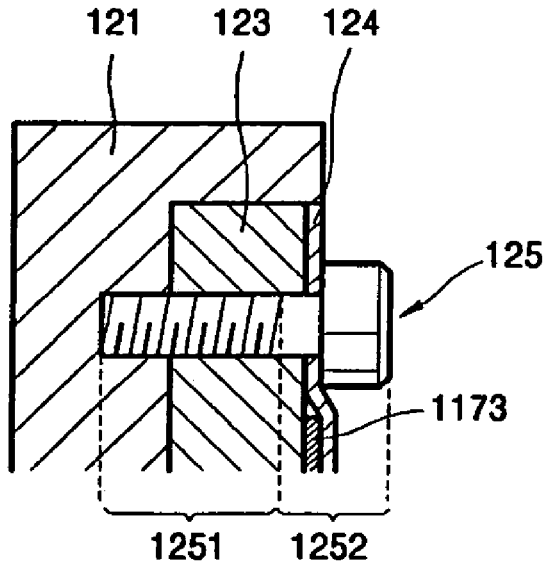
FIG. 3 is a sectional view illustrating an adherence member coupled at the end portion of the fusing roller of the fusing device of FIG. 1.

FIG. 3 is a sectional view illustrating the adherence member 124 coupled to the connection electrode 123 at the end portion of the fusing roller 110, according to an embodiment of the present general inventive concept. Referring to FIG. 3, the adherence member 124, the connection electrode 123, and the end cap 121 have screw holes that correspond to each other, and the connection electrode 123 and the end cap 121 have female screw holes. The bolt 125 may have a thread portion 1251 at a first end thereof, or a body portion of the bolt 125, and a non-thread portion 1252 in a second end thereof, or a head portion of the bolt 125. The non-thread portion 1252 can have a predetermined length that is at least equal to or greater than the thickness of the adherence member 124. When the bolt 125 is tightened, the bolt 125 moves forwards with respect to the connection electrode 123 due to the screw thread, and the bolt head presses the adherence member 124 towards the lead member 117 to press the contact portion 1173 of the lead member 117 against the connection electrode 123.

Figure 4:
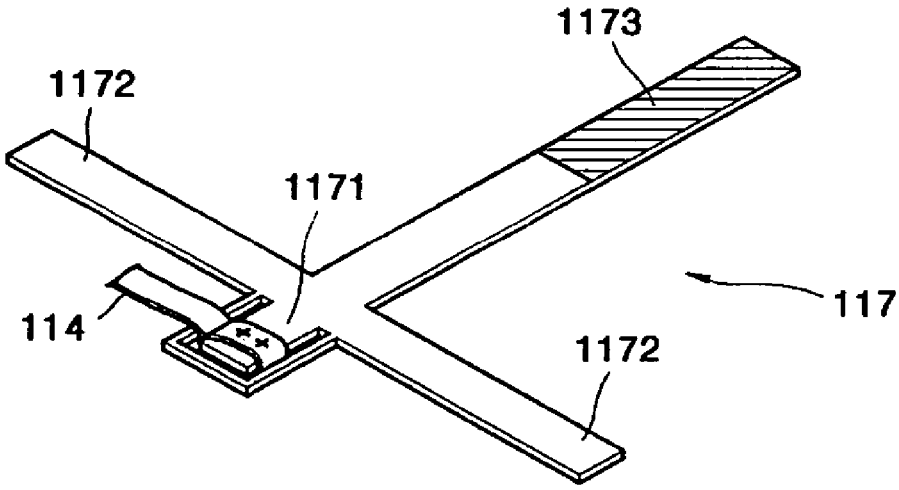
FIG. 4 is a perspective view illustrating an example of an end portion of a coil in the fusing roller of the fusing device of FIG. 1, according to an embodiment of the present general inventive concept.

FIG. 4 is a perspective view illustrating an example of an end portion of the coil 114 in the fusing roller 110, according to an embodiment of the present general inventive concept. As described above, the lead member 117 may be provided at the end portion of the coil 114. Referring to FIG. 4, one end portion of the lead member 117 is connected with the end portion of the coil 114 by welding or soldering such that electricity can flow therethrough. The contact portion 1173 is provided at another end of the lead member 117, to contact the connection electrode 123 (see FIG. 1). The contact portion 1173 can have a resistance reduction portion provided thereon, thereby reducing a contact resistance.

The lead member 117 may be made of a metal material having good conductivity and durability, such as phosphor bronze. The resistance reduction portion provided at the contact 1173 may be made of a material such as gold (Au), silver (Ag), platinum (Pt), and lead (Pb), which is coated on the lead member 117. Thus, corrosion does not appear at a contact surface with the connection electrode, and an increase of a contact resistance caused by oxidation can be prevented. A wing portion 1172 that extends from opposite sides of the lead member 117 is provided at one end of the lead member 117, and the wing portion 1172 covers the adherence portion 116 (see FIG. 1) of the fusing roller 110.

Figure 5:
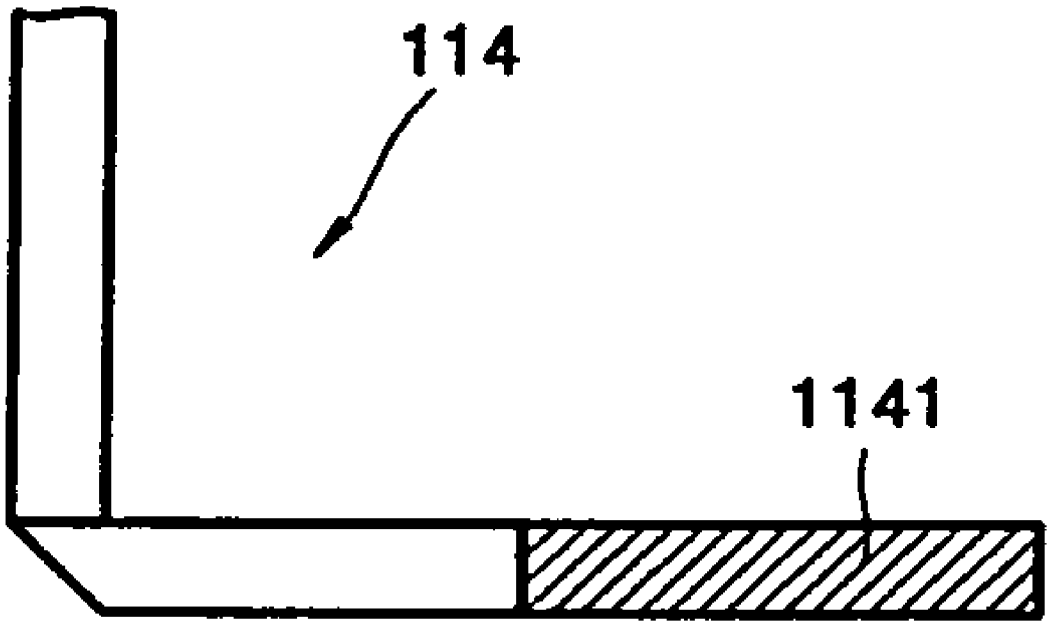
FIG. 5 is a perspective view illustrating an example of the end portion of the coil of the fusing roller of the fusing device of FIG. 1, according to another embodiment of the present general inventive concept.

FIG. 5 is a perspective view illustrating an example of the end portion of the coil 114 of the fusing roller 110, according to another embodiment of the present general inventive concept. Referring to FIG. 5, a resistance reduction portion 1141 is provided at the end portion of the coil 114. Accordingly, instead of using a separate lead member 117, as illustrated in FIG. 4, the coil 114 may have the resistance reduction portion 1141 at the end portion thereof coated with a material selected from the group consisting of gold (Au), silver (Ag), platinum (Pt), and lead (Pb).

Accordingly, in a fusing roller and a fusing device using the fusing roller according to the present general inventive concept, since physical contact between an end portion of a coil and a connection electrode is ensured by an adherence member, power can be stably supplied to the coil. As described above, the end portion of the coil can refer to both a portion of the coil extended from a wound portion of the coil or a lead member connected with the coil by welding or soldering.

Furthermore, both resistance heating and inducing heating can be generated by applying an alternating current to the coil.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fusing roller which applies heat to a toner image and fuses the toner image onto a piece of paper and which is heated by a coil connected to an external power source, the fusing roller comprising:

a pair of end caps provided at opposite ends of the fusing roller;

a connection electrode disposed in one of the end caps and connected to the external power source; and an adherence member coupled with the connection electrode, and having an end portion of the coil disposed between the adherence member and the connection electrode to ensure an electric connection between the coil and the connection electrode.

2. The fusing roller of claim 1, wherein the adherence member comprises a metal plate and is coupled with the connection electrode by screws.

3. The fusing roller of claim 1, wherein the adherence member is disposed at an outer surface of the connection electrode and is coupled with the connection electrode and the end cap by screws.

4. The fusing roller of claim 3, wherein the adherence member, the connection electrode, and the end cap respectively have screw holes corresponding to each other, and the screw holes of the connection electrode and the end cap are female screw holes to accommodate the screws.

5. The fusing roller of claim 4, wherein the screw coupled in each screw hole has a non-thread portion at a head portion of the screw, and the length of the non-thread portion is greater than or equal to a thickness of the adherence member.

6. The fusing roller of claim 1, further comprising:

a resistance reducing portion provided at the end portion of the coil to reduce a contact resistance with the connection electrode.

7. The fusing roller of claim 1, further comprising:

a lead member provided at the end portion of the coil, having one end connected with the coil and another end contacting the connection electrode, and having a resistance reducing portion to reduce a contact resistance with the connection electrode.

8. A fusing roller which applies heat to a toner image and fuses the toner image onto a piece of paper, the fusing roller comprising:

a coil which generates an alternating magnetic flux by an alternating current applied by an external power source through a connection structure; and an inducing heating portion disposed near the coil and heated by an inducing current induced by the alternating magnetic flux generated by the coil, wherein the connection structure comprises:

a pair of end caps provided at opposite ends of the fusing roller;

a connection electrode disposed in one of the end caps and connected to the external power source; and an adherence member coupled with the connection electrode, and having an end portion of the coil disposed between the adherence member and the connection electrode to ensure an electric connection between the coil and the connection electrode.

9. The fusing roller of claim 8, wherein the adherence member comprises a metal plate and is coupled with the connection electrode by screws.

10. The fusing roller of claim 8, wherein the adherence member is disposed at an outer surface of the connection electrode and is coupled with the connection electrode and the end cap by screws.

11. The fusing roller of claim 10, wherein the adherence member, the connection electrode, and the end cap respectively have screw holes corresponding to each other, and the screw holes of the connection electrode and the end cap are female screw holes.

12. The fusing roller of claim 11, wherein a bolt coupled in each screw hole has a non-thread portion at a head portion of the bolt, a length of the non-thread portion is greater than or equal to a thickness of the adherence member.

13. The fusing roller of claim 8, wherein the coil comprises a resistance reducing portion to reduce a contact resistance with the connection electrode provided at the end portion of the coil.

14. The fusing roller of claim 8, further comprising:

a lead member provided at the end portion of the coil, having one end connected with the coil and another end contacting the connection electrode, and having a resistance reducing portion to reduce a contact resistance with the connection electrode.

15. The fusing roller of claim 8, further comprising:

one or more insulation layers to insulate the coil from the inducing heating portion; and an adherence portion to hold the coil at a predetermined position near the inducing heating portion.

16. A fusing device which applies heat to a toner image and fuses the toner image onto a piece of paper and which includes a fusing roller heated by a coil connected to an external power source and a pressure roller that faces the fusing roller and rotates to press the piece of paper onto the fusing roller, wherein the fusing roller comprises:

a pair of end caps provided at opposite ends of the fusing roller;

a connection electrode disposed in one of the end caps and connected to the external power source; and an adherence member coupled with the connection electrode, and having an end portion of the coil disposed between the adherence member and the connection electrode to ensure an electric connection between the coil and the connection electrode.

17. A fusing device which applies heat to a toner image and fuses the toner image onto a piece of paper and which includes a fusing roller heated by a coil connected to an external power source and a pressure roller that faces the fusing roller and rotates to press the piece of paper onto the fusing roller, wherein the fusing roller comprises:

a coil which generates an alternating magnetic flux by an alternating current applied by an external power source through a connection structure; and an inducing heating portion which is placed near the coil and is heated by an inducing current induced by the alternating magnetic flux generated by the coil, wherein the connection structure comprises:

a pair of end caps provided at opposite ends of the fusing roller;

a connection electrode disposed in one of the end caps and connected to the external power source; and an adherence member coupled with the connection electrode, and having an end portion of the coil disposed between the adherence member and the connection electrode to ensure an electric connection between the coil and the connection electrode.

18. The fusing device of claim 17, wherein the adherence member comprises a metal plate and is coupled with the connection electrode by screws.

19. The fusing device of claim 17, wherein the adherence member is disposed at an outer surface of the connection electrode and is coupled with the connection electrode and the end cap by screws.

20. The fusing device of claim 19, wherein the adherence member, the connection electrode, and the end cap respectively have screw holes corresponding to each other, and the screw holes of the connection electrode and the end cap are female screw holes to accommodate the screws.

21. The fusing device of claim 20, wherein the screw coupled in each screw hole has a non-thread portion at the head portion of the screw, and a length of the non-thread portion is greater than or equal to a thickness of the adherence member.

22. The fusing device of claim 19, wherein the coil comprises a resistance reducing portion to reduce a contact resistance with the connection electrode provided at the end portion of the coil.

23. The fusing device of claim 17, further comprising:

a lead member provided at the end portion of the coil, having one end connected with the coil and another end contacting the connection, and having a resistance reducing portion to reduce a contact resistance with the connection electrode.

24. A fusing roller usable in an electrophotographic image forming apparatus to fuse an image onto a printing medium, comprising:

a connection electrode electrically connected to an external power source;

a coil to generate heat and having a connecting portion to contact a surface of the connection electrode to supply power to the coil; and an adherence member to press the connecting portion against the surface of the connection electrode and coupled with the connection electrode to hold the connecting portion against the connection electrode, wherein the connecting portion comprises an end portion of the coil disposed between the adherence member and the connection electrode to contact the surface of the connection electrode, the end portion of the coil comprises a resistance reduction portion to reduce a connection resistance between the end portion of the coil and the connection electrode.

25. The fusing roller of claim 24, wherein the connecting portion comprises a lead member having a first end connected with the coil and a second end disposed between the adherence member and the connection electrode to contact the surface of the connection electrode.

26. The fusing roller of claim 25, wherein the second end of the lead member comprises a resistance reduction portion to reduce a connection resistance between the second end of the lead member and the connection electrode.

27. A connecting unit to connect a coil of a fusing roller with an external power source, comprising:

an end cap disposed at an end of the fusing roller;

a connecting electrode disposed in the end cap, electrically connected to the external power source, and contacting an end portion of the coil to supply power to the coil; and an adherence member to hold the end portion of the coil against the connecting electrode and coupled with the connecting electrode to maintain the contact between end portion of the coil and the connecting electrode, wherein the adherence member is coupled with the end cap and the connecting electrode by bolts coupled with the end cap through the connecting electrode.

28. An electrophotographic image forming apparatus including a fusing roller which applies heat to a toner image and fuses the toner image onto a piece of paper arid which is heated by a coil connected to an external power source, the fusing roller comprising:

a pair of end caps provided at opposite ends of the fusing roller;

a connection electrode disposed in one of the end caps and connected to the external power source; and an adherence member coupled with the connection electrode, and having an end portion of the coil disposed between the adherence member and the connection electrode to ensure an electric connection between the coil and the connection electrode.

29. A fusing roller of an image forming apparatus, the fusing roller comprising:

a pair of end caps provided at opposite ends of the fusing roller;

a connection electrode disposed in at least one of the end caps and connected to an external power source; and an adherence member coupled with the connection electrode, and having a portion of a coil of the fusing roller disposed between the adherence member and the connection electrode to ensure an electric connection between the coil and the connection electrode, the adherence member being disposed at an outer surface of the connection electrode and coupled with the connection electrode and the at least one end cap by screws.

* * * * *